US008547300B2

(12) United States Patent
Kwak et al.

(10) Patent No.: US 8,547,300 B2
(45) Date of Patent: Oct. 1, 2013

(54) LIGHT EMITTING DISPLAY AND DISPLAY PANEL AND DRIVING METHOD THEREOF

(75) Inventors: Won-Kyu Kwak, Suwon-si (KR); Jin-Tae Jeong, Suwon-si (KR); Choon-Yul Oh, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1887 days.

(21) Appl. No.: 11/157,898

(22) Filed: Jun. 20, 2005

(65) Prior Publication Data

US 2006/0007073 A1 Jan. 12, 2006

(30) Foreign Application Priority Data

Jun. 30, 2004 (KR) ..... 10-2004-0050610

(51) Int. Cl.
*G09G 3/30* (2006.01)

(52) U.S. Cl.
USPC ..... 345/76; 345/55; 345/83; 345/204; 345/690; 315/169.2; 315/169.3

(58) Field of Classification Search
USPC ..... 345/77, 204, 76
See application file for complete search history.

(56) References Cited

U.S. PATENT DOCUMENTS 5,019,807 A 5/1991 Stapleton et al.
5,812,105 A * 9/1998 Van de Ven ..... 345/83
5,982,345 A * 11/1999 Takayama et al. ..... 345/76
6,011,530 A 1/2000 Kawahata et al.
6,069,597 A * 5/2000 Hansen ..... 345/74.1
6,097,365 A * 8/2000 Makino ..... 345/99
6,144,352 A * 11/2000 Matsuda et al. ..... 345/83
6,380,689 B1 4/2002 Okuda
6,411,047 B1 * 6/2002 Okazaki et al. ..... 315/312
6,421,033 B1 * 7/2002 Williams et al. ..... 345/55
6,618,031 B1 * 9/2003 Bohn et al. ..... 345/83
6,707,441 B1 3/2004 Hebiguchi et al.
6,919,868 B2 7/2005 Tam (Continued)

FOREIGN PATENT DOCUMENTS

CN 1490779 A 4/2004
CN 1495699 A 5/2004

(Continued)

OTHER PUBLICATIONS

Patent Abstracts of Japan, Publication No. 09-138659; Date of Publication: May 27, 1997; in the name of Chan-Long Shieh et al.

(Continued)

*Primary Examiner* — Grant Sitta
(74) *Attorney, Agent, or Firm* — Christie, Parker & Hale, LLP

(57) ABSTRACT

The present invention relates to a light emitting display, and display panel and driving method thereof. The display panel includes a plurality of data lines for transmitting a data signal, a plurality of scan lines for transmitting a selection signal, and a plurality of pixels coupled to the data lines and the scan lines. The pixel includes at least two emitters for emitting different colors from each other in response to an applied current, and a driver for receiving the data signal while the selection signal is applied and outputting a first current corresponding to the data signal. The driver outputs the first current to at least the first and second emitters for emitting substantially the same color among the emitters formed in the pixels.

20 Claims, 9 Drawing Sheets

(56) References Cited

U.S. PATENT DOCUMENTS

| | | | | |
|---|---|---|---|---|
| 6,943,766 | B2 | 9/2005 | Nakamura et al. | |
| 7,119,770 | B2 * | 10/2006 | Moon | 345/79 |
| 7,129,914 | B2 * | 10/2006 | Knapp et al. | 345/76 |
| 7,336,247 | B2 * | 2/2008 | Akimoto et al. | 345/82 |
| 8,111,224 | B2 * | 2/2012 | Park et al. | 345/83 |
| 8,154,481 | B2 * | 4/2012 | Lee et al. | 345/77 |
| 2001/0045944 | A1 * | 11/2001 | Iwasaki | 345/204 |
| 2002/0067327 | A1 | 6/2002 | Ozawa et al. | |
| 2002/0070909 | A1 | 6/2002 | Asano et al. | |
| 2002/0126074 | A1 * | 9/2002 | Ouellette et al. | 345/87 |
| 2002/0140659 | A1 | 10/2002 | Mikami et al. | |
| 2002/0149598 | A1 | 10/2002 | Greier et al. | |
| 2003/0030601 | A1 | 2/2003 | Komiya | |
| 2003/0142056 | A1 | 7/2003 | Okamoto | |
| 2003/0184505 | A1 | 10/2003 | Inukai et al. | |
| 2003/0222835 | A1 | 12/2003 | Yoon et al. | |
| 2004/0183764 | A1 | 9/2004 | Kim et al. | |
| 2004/0212633 | A1 * | 10/2004 | Natori et al. | 345/694 |
| 2004/0217932 | A1 | 11/2004 | Nally et al. | |
| 2005/0052365 | A1 | 3/2005 | Jang | |
| 2005/0168490 | A1 | 8/2005 | Takahara | |
| 2007/0152923 | A1 | 7/2007 | Baik et al. | |

FOREIGN PATENT DOCUMENTS

| | | | |
|---|---|---|---|
| EP | 0 241 562 | A1 | 10/1987 |
| EP | 0 637 009 | A2 | 2/1995 |
| EP | 0 637 009 | A3 | 3/1997 |
| EP | 1 441 325 | A2 | 7/2004 |
| EP | 1 441 325 | A3 | 12/2004 |
| EP | 1 536 406 | A1 | 6/2005 |
| EP | 1 594 118 | A1 | 11/2005 |
| JP | 9-138659 | | 5/1997 |
| JP | 2002-244619 | | 8/2002 |
| JP | 2003-510661 | | 3/2003 |
| JP | 2003-122306 | | 4/2003 |
| JP | 2004-078210 | | 3/2004 |
| JP | 2004-133240 | | 4/2004 |
| WO | WO 01/24153 | A1 | 4/2001 |
| WO | WO 03/077231 | A2 | 9/2003 |

OTHER PUBLICATIONS

Patent Abstracts of Japan, Publication No. 2002-244619; Date of Publication: Aug. 30, 2002; in the name of Munenori Ono et al.

Patent Abstracts of Japan, Publication No. 2003-122306; Date of Publication: Apr. 25, 2003; in the name of Akira Yumoto.

Patent Abstracts of Japan, Publication No. 2004-133240; Date of Publication: Apr. 30, 2004; in the name of Shin Asano et al.

U.S. Office action dated Mar. 10, 2010, for related U.S. Appl. No. 11/208,440, noting listed U.S. references 6,943,766 and 2002/0067327 in this IDS.

European Search Report dated Dec. 22, 2005, for European application 05107585.1, noting listed references in this IDS, namely, U.S. Patents 6,011,530, 6,707,441 and U.S. Publication 2002/0070909, and EP 0 241 562, EP 0 637 009 A2 & A3 and EP 1 441 325 A2 & A3.

U.S. Office action dated Aug. 5, 2008, for related U.S. Appl. No. 11/208,440, noting listed U.S. references in this IDS, namely, U.S. Publications 2002/0149598, 2003/0222835, 2004/0183764 and 2004/0217932.

U.S. Office action dated May 22, 2009, for related U.S. Appl. No. 11/208,440, noting listed U.S. references in this IDS, namely, U.S. Patents 6,380,689, 6,618,031, 6,919,868, and U.S. Publications 2002/0140659, 2003/0030601, 2003/0142056, 2004/0212633, 2005/0052365, and 2007/0152923.

* cited by examiner

LIGHT EMITTING DISPLAY AND DISPLAY PANEL AND DRIVING METHOD THEREOF

CROSS REFERENCE TO RELATED APPLICATION

This application claims priority to and the benefit of Korean Patent Application No. 10-2004-0050610 filed on Jun. 30, 2004 in the Korean Intellectual Property Office, the entire content of which is incorporated herein by reference.

BACKGROUND OF THE INVENTION

1. Field of the Invention

The present invention relates to a light emitting display, and more particularly to an organic light emitting diode (OLED) display utilizing an organic material to emit light.

2. Discussion of the Related Art

Generally, an OLED display emits light by electrically exciting an organic compound. Such OLED displays include N×M organic light emitting pixels arranged in the form of a matrix, and display images by driving the organic light emitting pixels using voltage or current. As shown in FIG. 9, each organic light emitting pixel has a structure which includes an anode electrode layer (e.g., indium tin oxide (ITO)), an organic thin film, and a cathode electrode layer. The organic thin film has a multi-layer structure including an emitting layer (EML), an electron transport layer (ETL), and a hole transport layer (HTL), and achieves an improved balance between electrons and holes, and thus, an enhancement in light emitting efficiency. The organic thin film also includes an electron injecting layer (EIL) and a hole injecting layer (HIL).

The OLED display panel may be driven using a passive matrix type driving method or an active matrix type driving method using thin film transistors (TFTs). In accordance with the passive matrix type driving method, anodes and cathodes orthogonal to each other are arranged so that desired lines may be selected and driven. In accordance with the active matrix type driving method, thin film transistors are coupled to respective ITO pixel electrodes in an OLED display panel so that the OLED display panel may be driven by a voltage maintained by the capacitance of a capacitor coupled to the gate of each thin film transistor.

The conventional OLED display includes a plurality of sub-pixels having distinct colors so that a spectrum of colors may be expressed by combining colors emitted from the plurality of sub-pixels. Conventionally, pixels are provided having sub-pixels for red, green, and blue; thus a spectrum of colors may be expressed by the pixels by using a combination of the red, green, and blue sub-pixels.

FIG. 1 shows a circuit diagram for representing one of N×M pixels as a conventional pixel circuit, equivalently representing a pixel arranged in a first row and a first column.

As shown in FIG. 1, a pixel 10 includes three sub-pixels 10*r*, 10*g*, and 10*b*. The sub-pixels 10*r*, 10*g*, and 10*b* respectively include OLED elements OLEDr, OLEDg, and OLEDb for respectively emitting red, green, and blue lights. Where sub-pixels are arranged in a stripe pattern, the sub-pixels 10*r*, 10*g*, and 10*b* are respectively coupled to data lines D1*r*, D1*g*, and D1*b*, and commonly coupled to a scan line S1.

The sub-pixel 10*r* for emitting a red light includes two transistors M1*r* and M2*r*, and a capacitor C1*r* for driving the OLED element OLEDr. The sub-pixel 10*g* for emitting a green light also includes two transistors M1*g* and M2*g*, and a capacitor C1*g*. The sub-pixel 10*b* for emitting a blue light also includes two transistors M1*b* and M2*b*, and a capacitor C1*b*.

Operations of the sub-pixels 10*r*, 10*g*, and 10*b* correspond to each other; accordingly, only the operation of the sub-pixel 10*r* will be described in detail below.

The driving transistor M1*r* is coupled between a power voltage VDD and an anode of the OLED element OLEDr, and transmits a current for emitting light to the OLED element OLEDr. The cathode of the OLED element OLEDr is coupled to a voltage Vss which is less than the power voltage VDD. The driving transistor M1*r* may be controlled by a data voltage applied through a switching transistor M2*r*. At this time, the capacitor C1*r* is coupled between a source and a gate of the transistor M1*r*, and maintains an applied voltage for a predetermined period. A gate of the transistor M2*r* is coupled to the scan line S1 for transmitting a on/off selection signal, and a source of the transistor M2*r* is coupled to the data line D1*r* for transmitting a data voltage corresponding to the sub-pixel 10*r* for emitting a red light.

A data voltage $V_{DATA}$ from the data line D1*r* is applied to the gate of the transistor M1*r* when the switching transistor M2*r* is turned on in response to a selection signal applied to the gate of the transistor M2*r*. A current $I_{OLED}$ flows to the transistor M1*r* which corresponds to a voltage $V_{GS}$ charged between the gate and the source by the capacitor C1*r*, and the OLED element OLEDr emits light corresponding to the magnitude of the current $I_{OLED}$. At this time, the current of $I_{OLED}$ flowing through the OLED element OLEDr is given as Equation 1.

$$I_{OLED} = \frac{\beta}{2}(V_{GS} - V_{TH})^2 = \frac{\beta}{2}(V_{DD} - V_{DATA} - |V_{TH}|)^2 \quad \text{[Equation 1]}$$

where $V_{TH}$ denotes a threshold voltage of the transistor M1*r*, and β denotes a constant.

In the pixel circuit shown in FIG. 1, a current corresponding to the data voltage is supplied to the OLED element OLEDr, and the OLED element OLEDr emits light with a brightness corresponding to the supplied current. At this time, the applied data voltage may have various values within a predetermined range in order to express predetermined gray scales.

As shown, the OLED display includes a pixel 10 including three sub-pixels 10*r*, 10*g*, and 10*b*. The respective sub-pixels include a driving transistor, a switching transistor, and a capacitor for driving an OLED element. A data line for transmitting a data signal and a power line for transmitting a power voltage VDD are formed for each sub-pixel. Accordingly, the OLED display must include a great number of lines and circuits for driving the pixels. These lines are difficult to arrange in a limited display area, and the aperture efficiency corresponding to an emitting pixel area is reduced. Therefore, it is desirable to develop a pixel circuit for reducing the number of lines and elements for driving a pixel.

SUMMARY OF THE INVENTION

In an exemplary embodiment, the present invention provides a light emitting display for increasing an aperture efficiency.

In another exemplary embodiment, the present invention provides a light emitting display for simplifying a configuration of elements in a pixel and lines.

In another exemplary embodiment, the present invention provides a pixel in which a variation of a driving transistor is compensated for.

In another exemplary embodiment, the present invention provides a pixel for controlling the white balance.

Additional embodiments of the invention will be set forth in the following description, and may in part be apparent from the description or learned by practice of the invention by one skilled in the art.

In one exemplary embodiment, a display panel includes a plurality of data lines for transmitting a data signal, a plurality of scan lines for transmitting a selection signal, and a plurality of pixels coupled to the data lines and the scan lines. The pixel includes at least two emission elements for emitting different colors from each other in response to an applied current, and a driver for receiving the data signal while the selection signal is applied and outputting a first current corresponding to the data signal. The driver outputs the first current to at least two emission elements for emitting substantially the same color among the emission elements formed in the plurality of pixels.

Another exemplary embodiment according to the present invention discloses a display panel. The display panel includes: a first pixel area in which a first driver for receiving a first data signal and outputting a first current corresponding to the first data signal, and first and second emission elements for respectively emitting a first color and a second color are formed; a second pixel area in which a second driver for receiving a second data signal and outputting a second current corresponding to the second data signal, and third and fourth emission elements for respectively emitting a third color and the first color; and a third pixel area in which a third driver for receiving a third data signal and outputting a third current corresponding to the third data signal, and fifth and sixth emission elements for respectively emitting the second color and the third color. The first driver sequentially applies the first current to the first and the fourth emission elements, the second driver sequentially applies the second current to the second and the fifth emission element, and the third driver sequentially applies the third current to the fourth and the sixth emission elements.

Yet another exemplary embodiment according to the present invention discloses a light emitting display. The light emitting display includes: a display area including a plurality of data lines for transmitting a data signal, a plurality of scan lines for transmitting a selection signal, and a plurality of pixels coupled to the data lines and the scan lines; a data driver for applying at least two data signals corresponding to a corresponding color in one field to the data lines while the data signals are time-divided; and a scan driver for sequentially applying a selection signal to the plurality of scan lines in first and second subfields included in the one field. The pixel includes at least two emission elements for emitting respective colors in response to an applied current, and a driver for operating the emission element by receiving the data signal while the selection signal is applied. The driver sequentially operates at least two emission elements for emitting the corresponding color among the emission elements included in the plurality of pixels.

Yet another exemplary embodiment according to the present invention discloses a method for driving a display panel including a plurality of data lines for transmitting a data signal, a plurality of scan lines for transmitting a selection signal, and a plurality of pixels respectively coupled to the data lines and the scan lines. The pixels include at least two emission elements for emitting respective colors, and operate dividing one field into a plurality of subfields including first and second subfields. In the method, a) the selection signal is sequentially applied to the plurality of scan lines in the first subfield, b) the data signal is applied to the plurality of data lines in a), c) a current corresponding to the data signal is transmitted to a first emission element among the emission elements included in the plurality of pixels, d) the selection signal is sequentially applied to the plurality of scan lines in a second subfield, e) the data signal is applied to the plurality of data lines in d), and f) the current corresponding to the data signal is transmitted to a second emission element for emitting a color substantially corresponding to the first emission element among the emission elements included in the plurality of pixels.

BRIEF DESCRIPTION OF THE DRAWINGS

The accompanying drawings, together with the specification, illustrate exemplary embodiments of the present invention, and together with the description serve to explain the principles of the invention.

DETAILED DESCRIPTION

Figure 1:
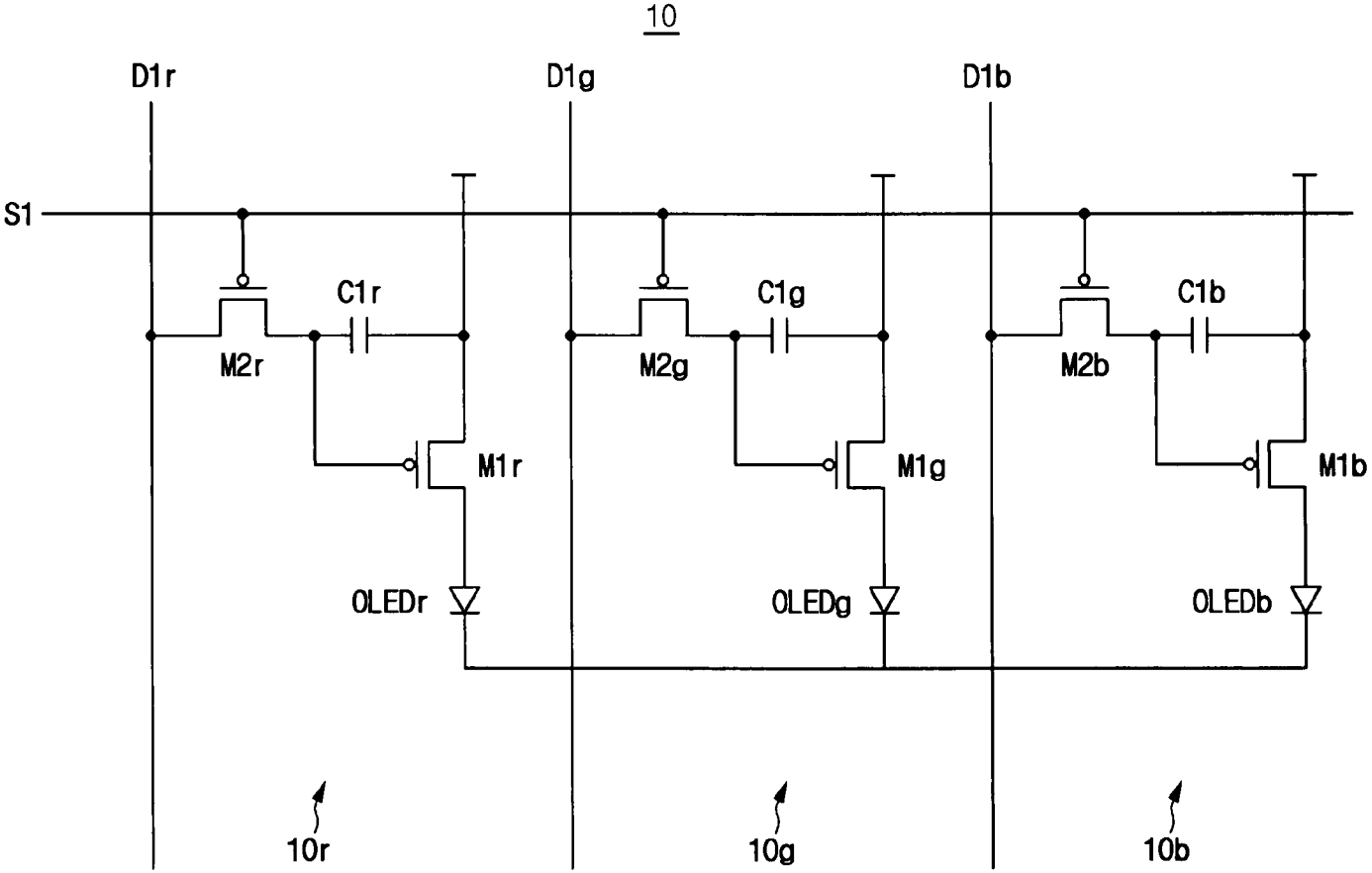
Fig. 1 (Prior art)
FIG. 1 shows a circuit diagram for representing one of N×M pixels as a conventional pixel circuit, equivalently representing a pixel arranged in a first row and a first column.

In the following detailed description, exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

There may be parts shown in the drawings, or parts not shown in the drawings, that are not discussed in the specification as they are not essential to a complete understanding of the invention. Further, like elements are designated by like reference numerals.

Exemplary embodiments of the present invention will now be described in detail with reference to the annexed drawings.

Figure 2:
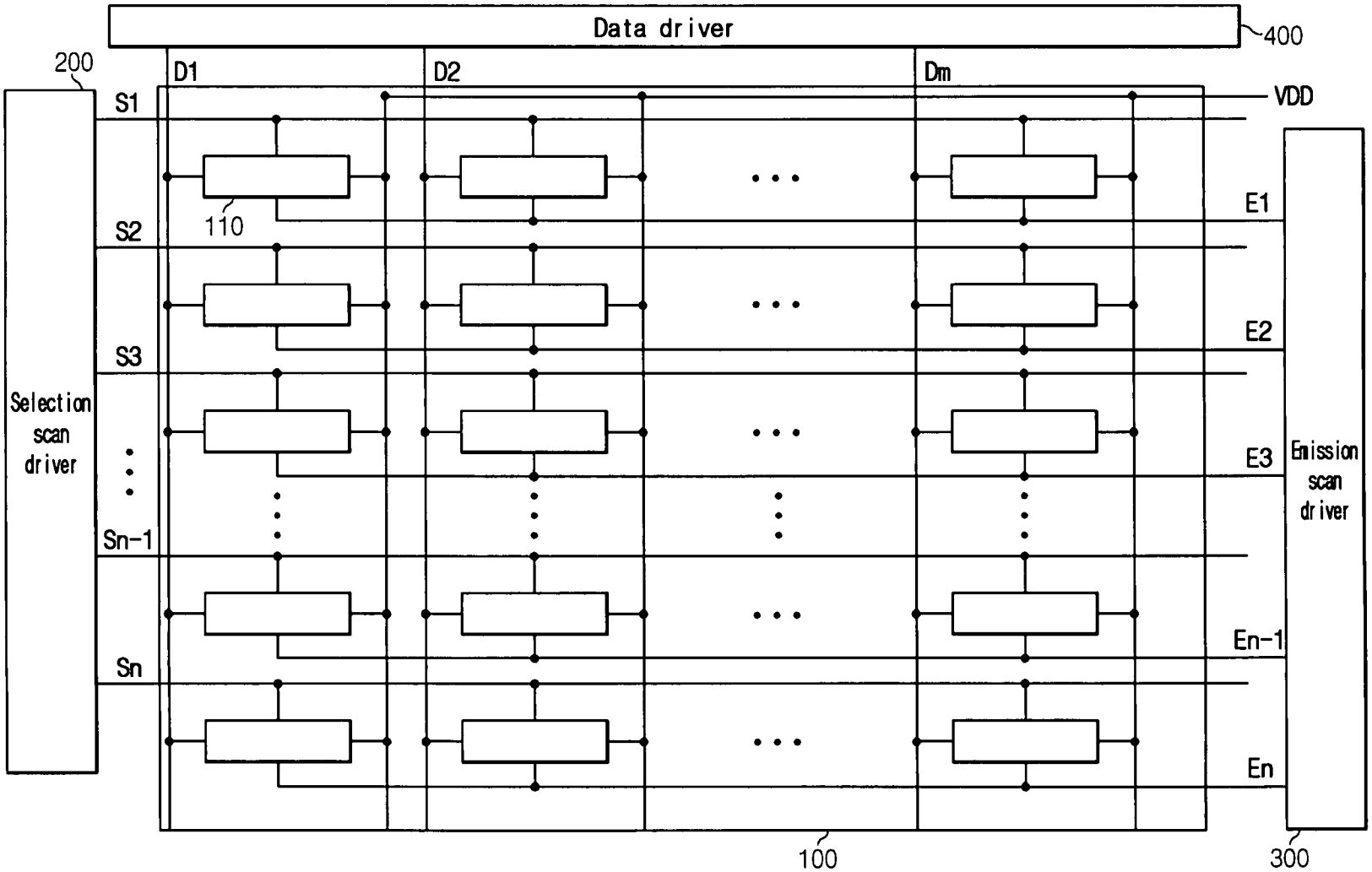
FIG. 2 schematically shows a configuration of an OLED display according to an exemplary embodiment of the present invention.
Figure 3:
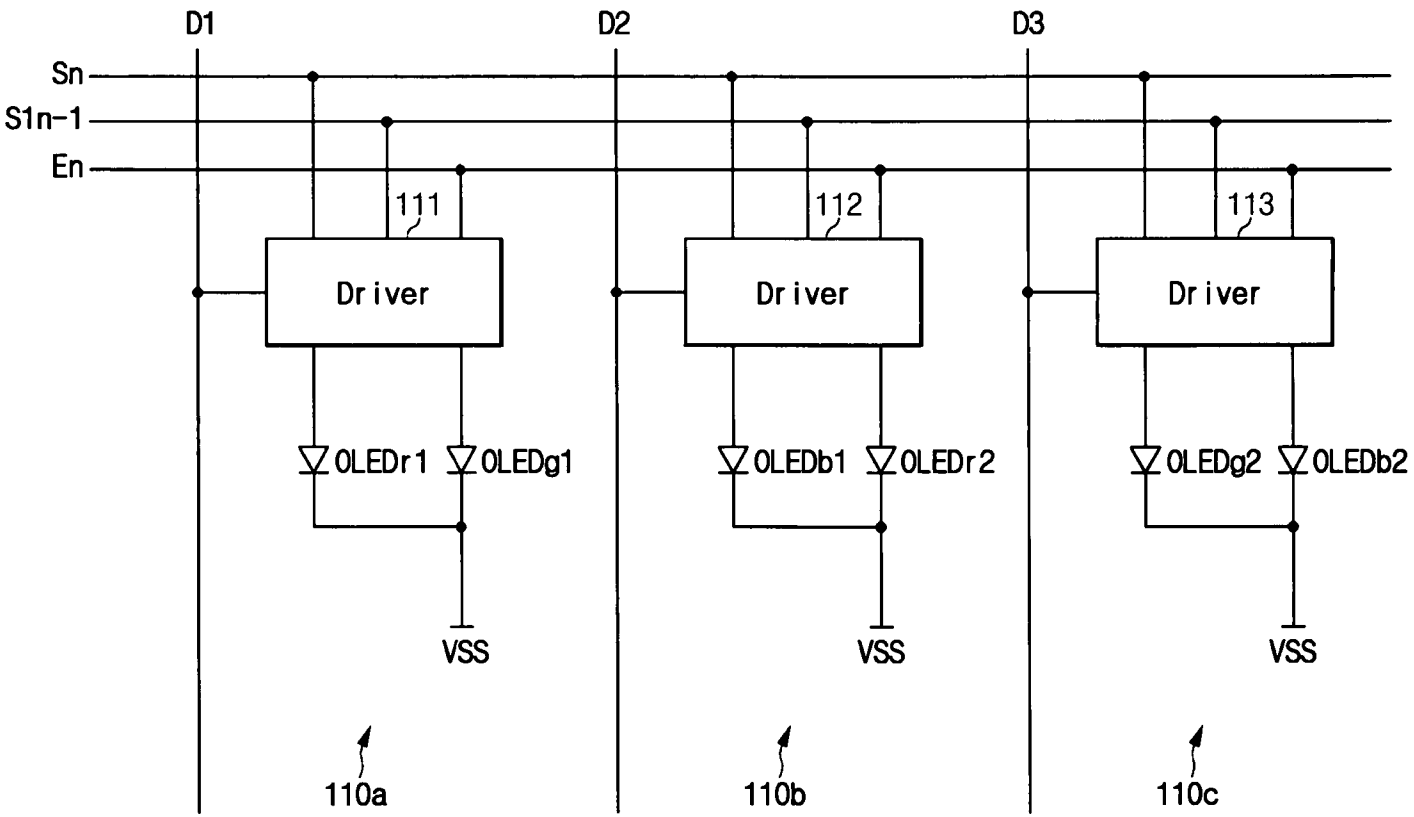
FIG. 3 schematically shows a diagram for representing a pixel of an OLED display of FIG. 2 according to a first exemplary embodiment of the present invention.

FIG. 2 schematically shows a configuration of an OLED display according to an exemplary embodiment of the present invention, and FIG. 3 schematically shows a diagram for representing a pixel of the OLED display shown in FIG. 2.

As shown in FIG. 2, the OLED display includes a display panel 100, a selection scan driver 200, an emission scan driver 300, and a data driver 400.

The display panel 100 includes a plurality of scan lines S1 to Sn and E1 to En arranged in a row direction, a plurality of data lines D1 to Dm and a plurality of power lines VDD arranged in a column direction, and a plurality of pixels 110. Each pixel is provided in an area defined by two neighboring scan lines S1 to Sn and two neighboring data lines D1 to Dm. By way of example, the pixels 110 may be any of pixels 110*a*, 110*b* and 110*c* shown in FIG. 3. As shown in FIG. 3, each pixel includes two OLED elements for emitting respective colors and a driver for operating the OLED element. The OLED element emits light having a brightness corresponding to an applied current. A driver and two OLED elements formed in a pixel area are defined as one pixel.

Returning now to FIG. 2, the selection scan driver 200 sequentially applies a selection signal to the plurality of scan lines S1 to Sn so that a data signal may be applied to the pixel coupled to the corresponding scan line. An emission scan driver 300 sequentially applies an emission control signal to emission scan lines E1 to En in order to control the emission of the OLED element. The data driver 400 applies a data signal to the data lines D1 to Dm when the selection signal is sequentially applied, which data signal corresponds to the pixel of the scan line to which the selection signal is applied.

The selection and emission scan drivers 200 and 300, and the data driver 400 are respectively coupled to a substrate in which the display panel 100 is formed. Alternatively, the scan drivers 200 and 300 and/or the data driver 400 may be directly formed on the glass substrate of the display panel 100 so that the selection and emission drivers 200 and 300, and/or data driver 400 may be substituted for driving circuits respectively formed on the same layers as those of the selection signal lines, data lines, and transistors. The scan drivers 200 and 300, and/or data driver 400 may also be formed as a chip provided on a flexible printed circuit (FPC), tape carried package (TCP), or tape automatic bonding (TAB) coupled to the display panel 100.

In a first exemplary embodiment of the present invention, one field is divided into two sub-fields, respective color data is applied to the two sub-fields, and an emission is generated.

The selection scan driver 200 sequentially applies the selection signal to the selection scan lines S1 to Sn for the respective subfields, and the emission scan driver 300 applies the emission control signal to the emission scan lines E1 to En so that the OLED elements having the respective colors are emitted in one subfield.

The data driver 400 applies the data signal corresponding to different color OLED elements to the data lines D1 to Dm in the two subfields. In FIG. 3, the data driver 400 (as shown in FIG. 2) applies data signals respectively corresponding to the red and green OLED elements OLEDr1 and OLEDg1 to the data line D1, and applies data signals respectively corresponding to the blue and red OLED elements OLEDb1 and OLEDr2 to the data line D2 in the two subfields. The data signals respectively corresponding to the green and blue OLED elements OLEDg2 and OLEDb2 are applied to the data line D3. The two OLEDs in the pixels 110*a*, 110*b* and 110*c* are driven by drivers 111, 112 and 113, respectively.

An operation of the OLED element according to the first exemplary embodiment of the present invention will now be described with reference to FIG. 4.

Figure 4:
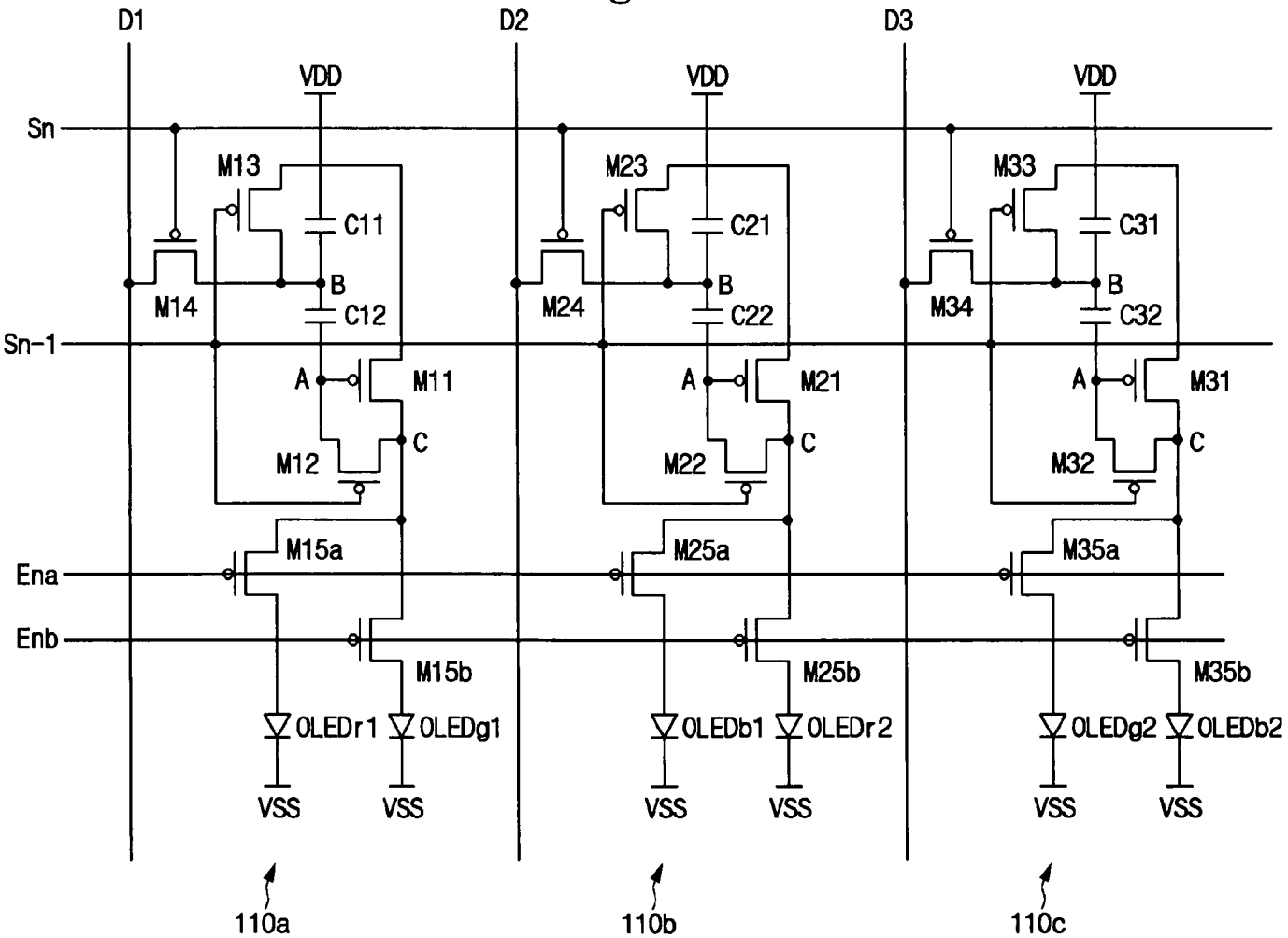
FIG. 4 shows a circuit diagram for representing the pixel of FIG. 3.

FIG. 4 shows a circuit diagram for representing a pixel of the OLED display according to the first exemplary embodiment of the present invention. A pixel coupled to the data lines D1 to D3 and the selection line Sn, and having p-channel transistors is illustrated in FIG. 4. Operations of three pixels 110*a* to 110*c* correspond substantially with each other; therefore only the pixel 110*a* will be described in detail below.

A scan line for transmitting a present selection signal will be referred to as "a present scan line" and a scan line for having transmitted a selection signal before the present selection signal is transmitted will be referred to as "a previous scan line."

The pixel 110*a* according to the first exemplary embodiment of the present invention includes a driving transistor M11, switching transistors M12 to M14, capacitors C11 and C12, OLED elements OLEDr1 and OLEDg1, and emission control transistors M15*a* and M15*b* for controlling emissions of the OLED elements OLEDr1 and OLEDg1.

One emission scan line En includes two emission control signal lines Ena and Enb. The remaining emission scan lines, while not illustrated in FIG. 4, respectively also include two emission control signal lines. The emission control transistors M15*a* and M15*b* and emission control signal lines Ena and Enb form a switching unit for selectively transmitting a current from the driving transistor M11 to the OLED elements OLEDr1 and OLEDg1.

The transistor M11 is a driving transistor for operating the OLED elements and is coupled between a power source for supplying a voltage VDD and a node of sources of the transistors M15*a* and M15*b*. A current flowing to the OLED elements OLEDr and OLEDg through the transistors M15*a* and M15*b* is controlled by a voltage applied between a gate and a source of the transistor M11. The transistor M12 controls the transistor M11 so that it may be diode-connected in response to a selection signal from a previous scan line Sn-1.

The gate of the transistor M11 is coupled to an electrode A of the capacitor C12, and the capacitor C11 and the transistor M13 are coupled in parallel between another electrode B of the capacitor C12 and the power for supplying the voltage of VDD. The transistor M13 supplies the voltage of VDD to the electrode B of the capacitor C12 in response to the selection signal from the previous scan line Sn-1.

The transistor M14 transmits a data voltage from the data line Dm to the capacitor C11 in response to the selection signal from the present scan line Sn.

The transistors M15*a* and M15*b* are respectively coupled between a drain of the transistor M11 and respective anodes of the OLED elements OLEDr1 and OLEDg1, and transmit a current from the transistor M11 to the OLED elements OLEDr1 and OLEDg1 in response to emission control signals applied from the emission control signal lines Ena and Enb.

The OLED elements OLEDr1 and OLEDg1 respectively emit red and green lights corresponding to an applied current. According to the exemplary embodiment of the present invention, a power voltage VSS, which is less than the voltage of VDD, is applied to cathodes of the OLED elements OLEDr1 and OLEDg1. A negative voltage or a ground voltage may be used as the power voltage VSS.

An operation of the pixel 110*a* according to the first exemplary embodiment of the present invention will now be described.

When a low level selection signal is applied to the previous scan line Sn-1, the transistor M12 is turned on, and the transistor M11 is diode-connected. Accordingly, a voltage between the gate and the source of the transistor M11 increases until it reaches a threshold voltage $V_{TH}$ of the transistor M11. At this time, the voltage of VDD is applied to the source of the transistor M11, Therefore a voltage applied to the electrode A of the capacitor C12 as well as the gate of the transistor M11 is the sum (VDD+$V_{TH}$). The transistor M13 is turned on which causes the voltage VDD to be applied to the electrode B of the capacitor C12.

Accordingly, a voltage charged to the capacitor C12 is given in Equation 2.

$$V_{C12}=V_{C12A}-V_{C12B}=(VDD+V_{TH})-VDD=V_{TH} \quad \text{[Equation 2]}$$

where $V_{C12}$ denotes a voltage charged to the capacitor C12, $V_{C12A}$ denotes a voltage applied to the electrode A of the capacitor C12, and $V_{C12B}$ denotes a voltage applied to the electrode B of the capacitor C12.

When a high level emission control signal is applied to the emission control signal lines Ena and Enb, the transistors M15*a* and M15*b* are turned off, and therefore no current flows to the OLED elements OLEDr and OLEDg through the transistor M11.

When a high level signal is applied to the present scan line Sn, the transistor M14 is turned off.

Further, when a low level selection signal is applied to the present scan line Sn, the transistor M14 is turned on, and the data voltage $V_{DATA}$ is charged to the capacitor C11. A voltage corresponding to a threshold voltage $V_{TH}$ of the transistor M11 is charged to the capacitor C12, and therefore a voltage corresponding to a sum of the data voltage $V_{DATA}$ and the threshold voltage $V_{TH}$ of the transistor M11 is applied to the gate of the transistor M11.

A voltage $V_{GS}$ between the gate and the source of the transistor M11 is defined in Equation 3. When the transistors M15*a* and M15*b* are turned on in response to the respective emission control signals from the emission control signal lines Ena and Enb, a current defined in Equation 4 is transmitted to the OLED elements OLEDr1 and OLEDg1, and an emission of light is generated.

$$V_{GS}=(V_{DATA}+V_{TH})-VDD \quad \text{[Equation 3]}$$

$$I_{OLED}=\frac{\beta}{2}(V_{GS}-V_{TH})^2=\frac{\beta}{2}((V_{DATA}+V_{TH}-VDD)-V_{TH})^2=\frac{\beta}{2}(VDD-V_{DATA})^2 \quad \text{[Equation 4]}$$

where $I_{OLED}$ denotes a current flowing to the OLED elements OLEDr1 and OLEDg1, $V_{GS}$ denotes a voltage between the gate and the source of the transistor M11, $V_{TH}$ denotes a threshold voltage of the transistor M11, $V_{DATA}$ denotes a data voltage, and β denotes a constant.

The selection signal is sequentially applied to the selection scan lines S1 to Sn in the two subfields included in one field, and the two emission control signals respectively applied to the two emission control signal lines E1*a* to Ena and E1*b* to Enb have a low level period which is not overlapped in one field.

The pixel 110*b* and 110*c* charge threshold voltages of the driving transistors M21 to M31 in the capacitors C22 and C32 while the selection signal is applied to the previous selection signal line Sn-1, and charge the data voltage $V_{DATA}$ to the capacitor C21 and C31 while the selection signal is applied to the present scan line Sn in the like manner of the pixel 110*a*. When the emission control transistors M25*a* and M35*a* are turned on in response to the emission control signal from each emission control signal line Ena, currents respectively corresponding to the voltages charged to the capacitors C21 and C31 are transmitted to the green and blue OLED elements OLEDb1 and OLEDg2, and the emission is generated. When the emission control transistors M25*b* and M35*b* are turned on in response to the emission control signal from each signal line Enb, the currents corresponding to the voltages charged on the capacitors C21 and C31 are transmitted to the red and blue OLED elements OLEDr2 and OLEDb2, and the emission is generated.

According to the first exemplary embodiment of the present invention, various color emission elements are operated by a switching transistor and a capacitor in a common operation and therefore a configuration of elements used in the pixel and lines for transmitting a current, a voltage, and a signal are simplified.

However, when the pixel according to the first exemplary embodiment of the present invention actually operates, the voltage charged to the capacitors C12 to C32 is varied at the nodes C, the drain electrodes of the driving transistors M11 to M31, in practice differently from the relation described by Equation 2. Specifically, when a current flows through the driving transistors M11 to M31, a predetermined voltage is charged by parasitic capacitance of the drain electrode at node C, and a voltage of the node C is affected by a current level flowing to the driving transistors M11 to M31 in a previous subfield. Accordingly, when the low level selection signal is applied to the previous scan line Sn-1, a voltage of $V_{C12}$ of the electrode A of the capacitor C12 corresponds to the voltage of the node C, and therefore a voltage to be charged to the capacitor C12 is varied according to the voltage of the node C.

In the pixels 110*a* to 110*c* according to the first exemplary embodiment of the present invention, currents corresponding to respective colors flow through the driving transistors M11 to M31 in the two subfields, and therefore a compensation voltage charged to the capacitors C12 to C32 is affected by a current flowing from the driving transistors M11 to M31 in the previous subfield while the selection signal is applied to the previous scan line Sn-1 in one subfield.

Accordingly, because the compensation voltage according to the data voltage of the previous subfield is charged to the capacitors C12 to C32, data voltages respectively corresponding to different colors are applied in the previous subfield and in the present subfield and therefore a variation of the threshold voltage of the driving transistors M11 to M31 is not properly compensated.

In the pixel according to the first exemplary embodiment of the present invention, the driving transistor operates OLED elements with different colors, and therefore it is difficult to control the white balance of red, green, and blue images by controlling characteristics of the driving transistor.

Accordingly, in an OLED display according to a second exemplary embodiment of the present invention, a driver formed in one pixel operates OLED elements having a corresponding color.

A pixel of the OLED display according to the second exemplary embodiment of the present invention will now be described with reference to FIG. 5 to FIG. 7.

Figure 5:
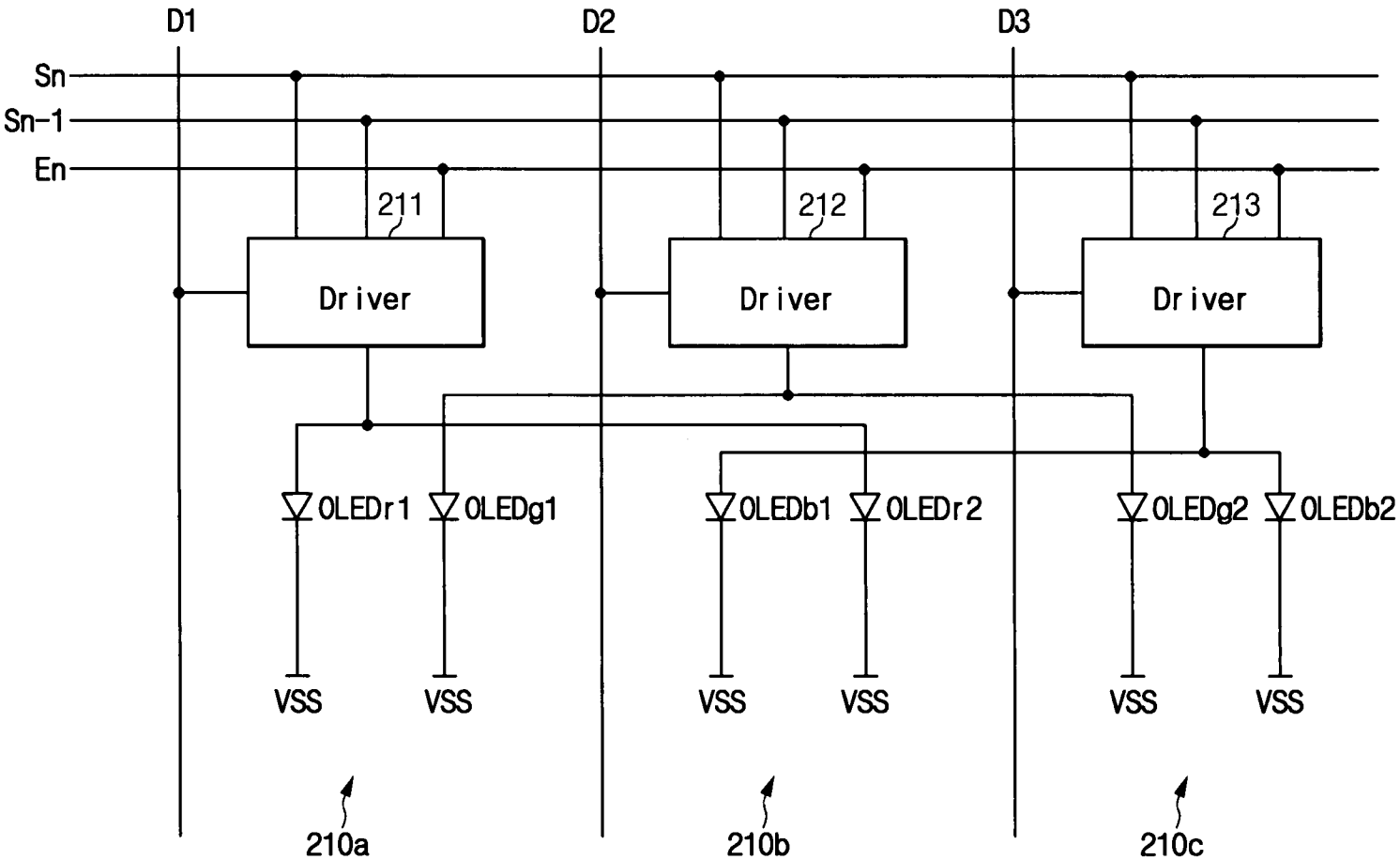
FIG. 5 shows a schematic diagram for representing a pixel of an OLED display according to a second exemplary embodiment of the present invention.

FIG. 5 shows a schematic diagram for representing a pixel of the OLED display according to the second exemplary embodiment of the present invention. Three pixels 210*a* to 210*c* coupled to data lines D1 to D3 and a selection scan line Sn are represented for convenience of description in FIG. 5. The pixels 210*a* to 210*c* may, for example, be used as the pixels 110 of FIG. 2.

According to the second exemplary embodiment of the present invention, each of the pixels 210*a* to 210*c* includes a driver and two OLED elements for emitting different colored lights, and red, green, and blue data signals are respectively applied to the data lines D1 to D3.

A driver 211 of the pixel 210*a* is coupled to the data line D1, and applies a current corresponding to a data voltage from the data line D1 to red OLED elements OLEDr1 and OLEDr2. A driver 212 of the pixel 210*b* is coupled to the data line D2, and applies a current corresponding to a data voltage from the data line D2 to green OLED elements OLEDg1 and OLEDg2. A driver 213 of the pixel 210*c* is coupled to the data line D3, and applies a current corresponding to a data voltage from the data line D3 to blue OLED elements OLEDb1 and OLEDb2.

Figure 6:
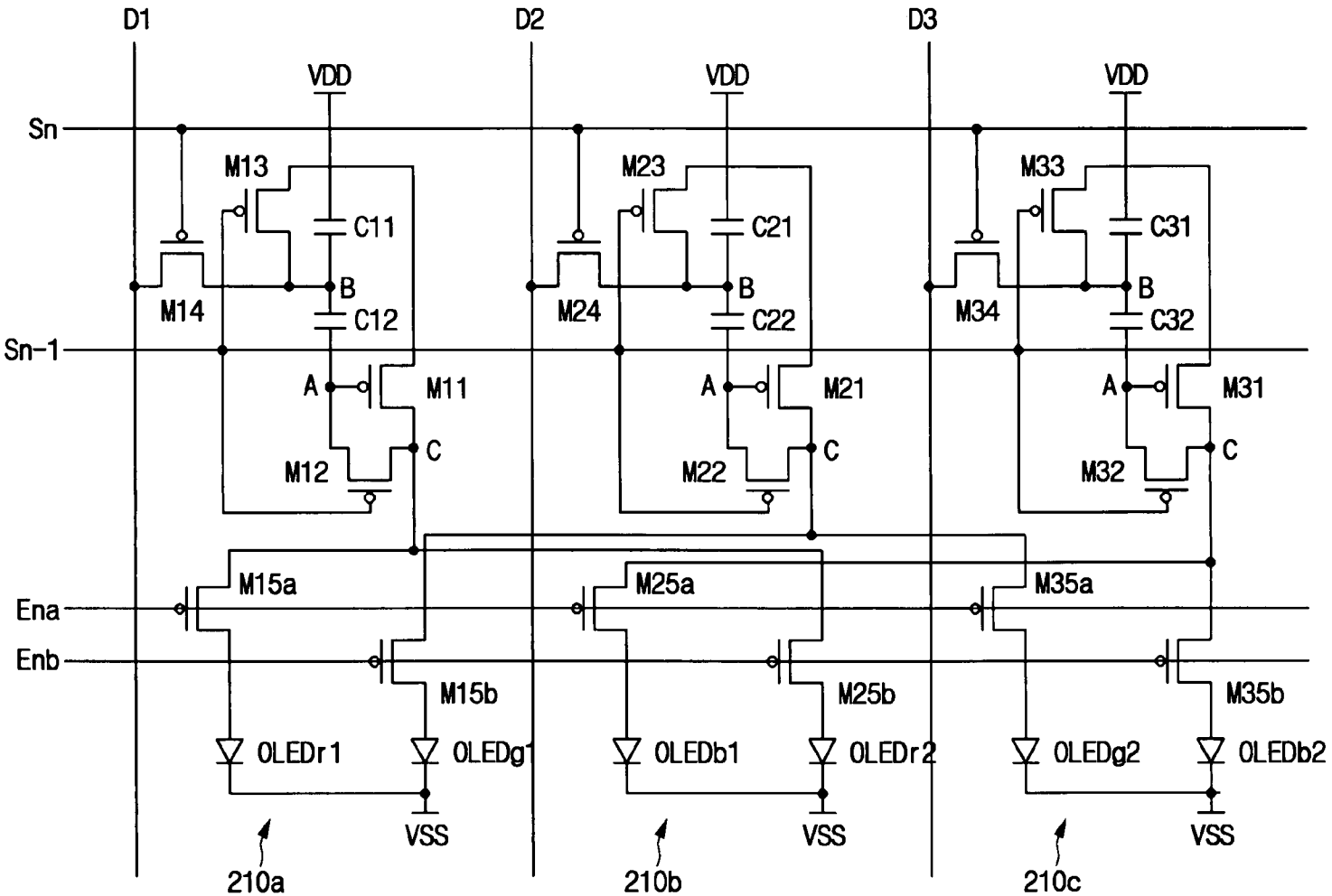
FIG. 6 shows a circuit diagram for representing the pixel of the OLED display of FIG. 5.

As shown in FIG. 6, the driver of the pixel 210*a* includes a driving transistor M11, switching transistors M12 to M14, capacitors C11 and C12, and emission control transistors M15*a* and M15*b*. The driver of the pixel 210*b* includes a driving transistor M21, switching transistors M22 to M24, capacitors C21 and C22, and emission control transistors M25*a* and M25*b*. The driver of the pixel 210*c* includes a driving transistor M31, switching transistors M32 to M43, capacitors C31 and C32, and emission control transistors M35*a* and M35*b*.

According to the second exemplary embodiment of the present invention, a drain of the driving transistor M11 of the pixel 210*a* is coupled to sources of the emission control transistors M15*a* and M25*b*. The emission control transistors M15*a* and M25*b* transmit a current from the driving transistor M11 to the OLED elements OLEDr1 and OLEDr2 in response to the respective emission control signals of the emission control signal lines Ena and Enb.

A drain of the driving transistor M21 is coupled to sources of the emission control transistors M35*a* and M15*b*, and the emission control transistors M35*a* and M15*b* transmit a current from the driving transistor M21 to the OLED elements OLEDg2 and OLEDg1 in response to the respective emission control signals of the emission control signal lines Ena and Enb.

A drain of the driving transistor M31 is coupled to sources of the emission control transistors M25*a* and M35*b*, and the emission control transistors M25*a* and M35*b* transmit a current from the driving transistor M31 to the OLED elements OLEDb2 and OLEDb1 in response to the respective emission control signals of the emission control signal lines Ena and Enb.

The data voltage corresponding to one color is applied to one data line in one field, and the driving transistor transmits a current corresponding to the data voltage to the corresponding color OLED elements.

An operation of the OLED display according to the second exemplary embodiment of the present invention will now be described with reference to FIG. 7.

Figure 7:
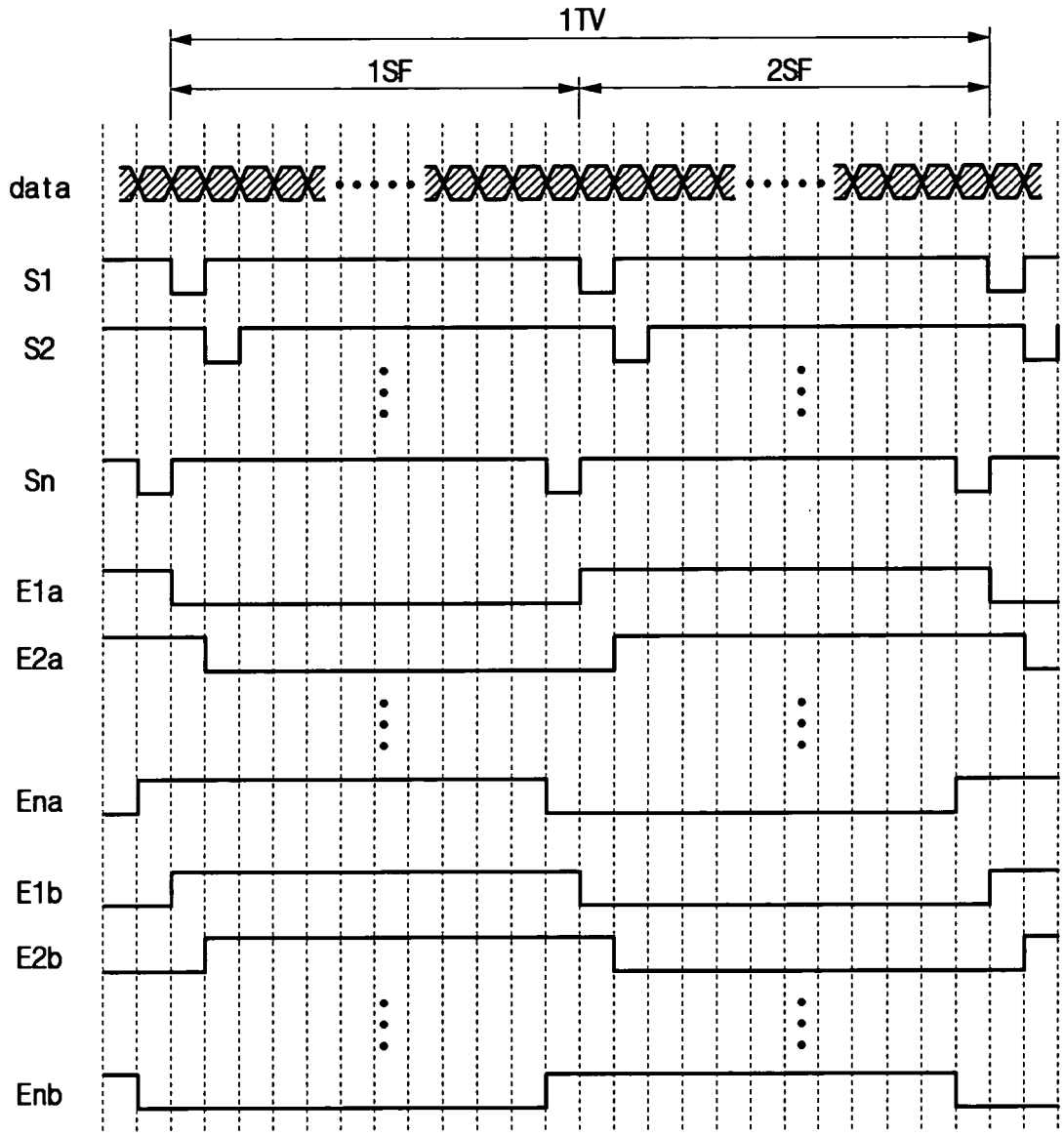
FIG. 7 shows a driving timing chart of a OLED display of the second exemplary embodiment of the present invention.

FIG. 7 shows a driving timing chart of the OLED display of the second exemplary embodiment of the present invention.

The OLED display according to the second exemplary embodiment of the present invention operates dividing one field 1TV into two subfields 1SF and 2SF. The low level selection signal is sequentially applied to the selection scan lines S1 to Sn in the respective subfields 1SF and 2SF. The two OLED elements included in one pixel respectively emit for a period corresponding to one subfield. The subfields 1SF and 2SF are respectively defined for each row, and are illustrated with reference to a first row selection scan line S1.

Voltages corresponding to threshold voltages $V_{TH}$ of the driving transistors M11 to M31 are charged to the capacitors C12 to C32 while the low level selection signal is applied to the previous scan line Sn-1 in the subfield 1SF. When the low level selection signal is applied to the present scan line Sn, red, green, and blue data voltages are applied to the data lines D1 to D3, and the data voltage is charged to the capacitors C11 to C31 through the transistors M14 to M34. The emission control transistors M15*a*, M35*a*, and M25*a* are turned on, the currents corresponding to the voltages charged in the capacitors C11 to C31 are respectively transmitted from the transistors M11 to M31 to the OLED elements OLEDr1, OLEDg2, and OLEDb1, and the emission is generated.

In the like manner above, the data voltage is applied to first through $n^{th}$ pixel in the subfield 1SF, and the left OLED element of the two OLED elements in one pixel is emitted.

In the subfield 2F, the low level selection signal is sequentially applied to the first through the $n^{th}$ row selection scan lines S1 to Sn in the like manner as in the previous subfield 1SF. In the pixels 210*a* to 210*c* coupled to the present scan line Sn, the threshold voltages of the driving transistors M11 to M31 are charged to the capacitors C12 to C32 while the selection signal is applied to the previous scan line Sn-1, the data voltages corresponding to red, green, and blue are applied to the data lines D1 to D3 and charged to the capacitors C11 to C31 while the selection signal is applied to the present scan line Sn. The low level emission control signal is applied to the emission control signal lines E1*b* to Enb while the low level selection signal is sequentially applied to the selection signals S1 to Sn. A current corresponding to the applied data voltage is transmitted to the OLED elements OLEDr2, OLEDg2, and OLEDb2 through the emission control transistors M25*b*, M15*b*, and M35*b*, and the emission is generated.

According to the exemplary embodiment of the present invention, the emission control signal applied to the emission control signal lines E1*a* to Ena and E1*b* to Enb in the subfields 1SF and 2SF is maintained at the low level for a predetermined period, and the OLED element coupled to the emission control transistor to which a corresponding emission control signal is applied is emitted while the emission control signal is maintained at the low level. This period is shown substantially corresponding to the respective subfields 1SF and 2SF in FIG. 7. Accordingly, the left OLED element in each pixel emits with a brightness corresponding to the data voltage applied for a period corresponding to the subfield 1SF while the right OLED element emits with brightness corresponding to the data voltage applied for a period corresponding to the subfield 2SF.

The data voltages respectively corresponding to one color are applied to the respective data lines D1 to Dm in one field 1TV, and the driving transistor included in one pixel transmits a current corresponding to the data voltage to the corresponding color OLED element. Accordingly, the current corresponding to one color is transmitted to the OLED element through the driving transistor in two subfields, and therefore a voltage corresponding to the current of the color corresponding to the present subfield is charged to the drain electrode of the driving transistor at node C.

Therefore, when the selection signal is applied to the previous scan line Sn-1 and a voltage corresponding to the threshold voltage of the transistor M11 is charged to the capacitor C12, the voltage charged to the capacitor C12 is affected by the voltage of the node C which in turn is affected by the current flowing through the transistor M11 in the previous subfield as described above. This current which the driving transistor M11 outputs corresponds to red in the previous subfield and the present subfield, and therefore the voltage for compensating the variation of the threshold voltage of the transistor M11 is charged to the capacitor C12. The voltage corresponding to the threshold voltage is charged to the capacitor C12 in the present subfield and the previous subfield under the same condition even though the parasitic capacitance is provided in the drain electrode of the driving transistor M11 and a voltage which is different from the threshold voltage of the driving transistor M11 is charged to the capacitor C12. Accordingly, the variation of the threshold voltage of the driving transistor M11 may be effectively compensated for.

The driving transistor in one pixel respectively controls the current flowing to the corresponding color OLED element in one field, width and length ratios of the driving transistor channel are controlled, and therefore the white balance of the display panel is controlled. Therefore, in FIG. 6, the width and length ratios of the channels of the driving transistors M11 to M13 are established to be different from each other, and the currents having different quantities are established to respectively flow to red, green, and blue OLED elements by a level data voltage.

While the driver of the pixel according to the second exemplary embodiment of the present invention includes a driving transistor, four switching transistors, two capacitors, and two emission control transistors in FIG. 6, the OLED display according to the second exemplary embodiment of the present invention may be formed by using various types of pixels.

Figure 8:
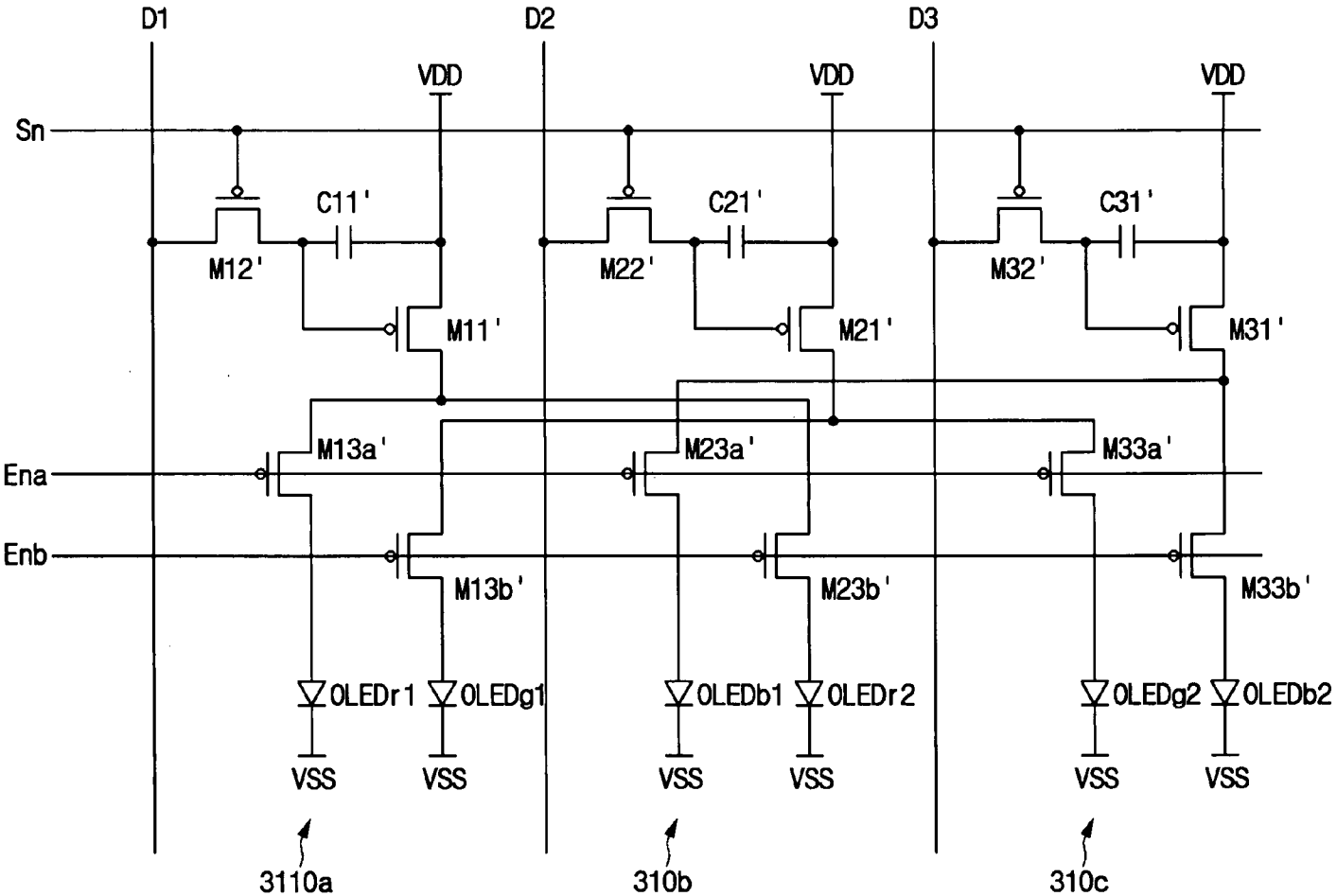
FIG. 8 shows a diagram for representing another pixel of the OLED display according to the second exemplary embodiment of the present invention.
Figure 9:
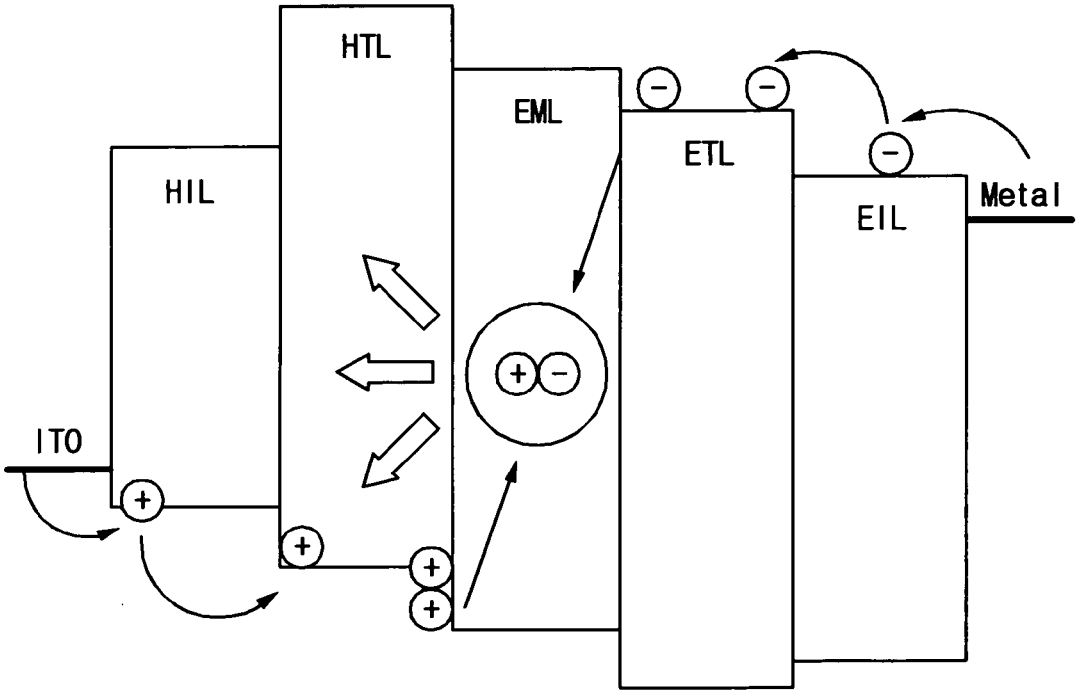
FIG. 9 is a conceptual diagram of an OLED.

FIG. 8 shows a diagram for representing another pixel of the OLED display according to the second exemplary embodiment of the present invention, which will now be described focusing on a driver in a pixel 310*a* among pixels 310*a* to 310*c* shown. The pixels 310*a*, 310*b* and 310*c* may, for example, be used as the pixels 110 of FIG. 2.

The pixel 310*a* includes a driving transistor M11', a switching transistor M12', a capacitor C11', two OLED elements OLEDr1 and OLEDg1, and emission control transistors M13*a*' and M13*b*' for respectively controlling the emission of the OLEDr1 and OLEDg1.

The switching transistor M12' transmits the data voltage from the data line D1 to the capacitor C11' in response to the selection signal from the scan line Sn. The driving transistor M11' is coupled between the power voltage VDD and the emission control transistors M13*a*' and M23*b*', and outputs a current corresponding to the voltage charged to the capacitor C11'.

Therefore, a current corresponding to the voltage charged to the capacitor C11' is transmitted to the OLED element OLEDr1 flowing through the driving transistor M11' when the emission control transistor M13*a*' is turned on in response to the emission control signal from the emission control signal line Ena the current corresponding to the voltage charged to the capacitor C11 is transmitted to the OLED element OLEDr2 when the emission control transistor M23*b* is turned on in response to the emission control signal from the emission control signal line Enb.

As described, in another pixel of the OLED display according to the second exemplary embodiment of the present invention, as the driving transistor operates the OLED elements for emitting a corresponding color, the width and length of the driving transistor channel is controlled, and with it the white balance.

While the OLED display operates in single scan and progressive scan methods in FIG. 7, various methods such as dual scan and interlaced scan methods may be applied in the present invention.

While one pixel includes two OLED elements in FIG. 6 and FIG. 8, a field may be divided into three subfields in order to drive a pixel circuit when one pixel is established to include OLED elements for emitting red, green and blue.

According to the present invention, various color emission elements are operated in common by a switching transistor and a capacitor, therefore simplifying a configuration of elements used in the pixel circuit and respective lines for transmitting a current, a voltage and a signal.

A driving transistor operates the OLED elements having a corresponding color, and therefore the threshold voltage of the driving transistor is effectively compensated under the same condition.

The width and length ratios of the driving transistor channel operating the OLED elements emitting different colors are controlled, and therefore the white balance of the display panel may also be controlled.

It will be apparent to those skilled in the art that modifications and variations may be made in the present invention without departing from the spirit or scope of the invention. Thus, it is intended that the present invention cover the modifications and variations of this invention provided they come within the scope of the appended claims and their equivalents.

What is claimed is:

1. A display panel comprising:

a plurality of data lines for transmitting a data signal;

a plurality of scan lines for transmitting a selection signal; and a plurality of pixels each coupled to a corresponding one of the data lines and a corresponding one of the scan lines, each of at least one of the pixels comprising:

at least two emission elements for emitting different colors from each other in response to an applied current; and a driver for receiving the data signal while the selection signal is applied, and outputting a first current corresponding to the data signal, wherein the driver sequentially outputs the first current to only two emission elements for emitting substantially the same color among the emission elements formed in the plurality of pixels, the two emission elements for emitting substantially the same color having at least one other emission element for emitting a different color positioned therebetween.

2. The display panel of claim 1, wherein the data signal input to the driver represents an image of substantially the same color.

3. The display panel of claim. 1, wherein a field comprises first and second subfields, and wherein the driver transmits the first current to a first emission element of the corresponding two emission elements in the first subfield, and wherein the driver transmits the first current to a second emission element of the corresponding two emission elements in the second subfield.

4. The display of claim 3, wherein the at least one of the pixels further comprises first and second switches respectively coupled between the driver and the first emission element, and between the driver and the second emission element.

5. The display of claim 1, the driver comprising:

a transistor comprising a first electrode, a second electrode, and a third electrode for outputting a current through the third electrode, the current corresponding to a voltage applied between the first electrode and the second electrode;

a first capacitor coupled between the first and second electrodes of the transistor; and a third switch for transmitting the data signal to the capacitor in response to the selection signal.

6. The display of claim 5, wherein the second electrode of the transistor is coupled to a first power source, and the driver further comprises:

a second capacitor coupled between the first electrode of the transistor and the first capacitor, a fourth switch for controlling the transistor to be diode-connected in response to a first control signal, and a fifth switch coupled to the second capacitor for applying a voltage of the first power source to the first capacitor in response to a second control signal.

7. The display panel of claim 6, wherein the first control signal and the second control signal substantially correspond to each other.

8. The display panel of claim 7, wherein the first control signal is a selection signal of a previous scan line applied prior to application of the selection signal.

9. The display panel of claim 6, wherein the plurality of data lines include a first data line group, a second data line group, and a third data line group for transmitting the data current corresponding to a first color, a second color, and a third color, and wherein corresponding pixels of the plurality of pixels are respectively coupled to the first data line group, second data line group, and third data line group.

10. The display of claim 9, wherein a white balance of the first color, the second color, and the third color is controlled by controlling width and length ratios of a channel of the transistor of each of the corresponding pixels respectively coupled to the first data line group, the second data line group, and the third data line group.

11. The display of claim 1, wherein the plurality of the pixels includes neighboring first pixel, second pixel, and third pixel, wherein the first pixel includes two emission elements for respectively emitting a first color and a second color, the second pixel includes two emission elements for respectively emitting a third color and the first color, and the third pixel includes two emission elements for respectively emitting the second color and the third color, wherein a driver of the first pixel outputs the first current to the two emission elements for emitting the first color, a driver of the second pixel outputs the first current to the two elements for emitting the second color, and a driver of the third pixel outputs the first current to the two emission elements for emitting the third color.

12. The display panel of claim 11, wherein the first pixel, second pixel, and third pixel are repeatedly formed.

13. A display panel comprising a plurality of pixel areas each defined by two neighboring scan lines and two neighboring data lines, the plurality of pixel areas including:

a first pixel area comprising a first driver for receiving a first data signal and outputting a first current corresponding to the first data signal, and first and second emission elements for respectively emitting a first color and a second color;

a second pixel area comprising a second driver for receiving a second data signal and outputting a second current corresponding to the second data signal, and third and fourth emission elements for respectively emitting a third color and the first color; and a third pixel area comprising a third driver for receiving a third data signal and outputting a third current corresponding to the third data signal, and fifth and sixth emission elements for respectively emitting the second color and the third color, wherein the first driver sequentially applies the first current to only the first and fourth emission elements from among the emission elements in the display panel, the second driver sequentially applies the second current to only the second and fifth emission elements from among the emission elements in the display panel, and the third driver sequentially applies the third current to only the third and sixth emission elements from among the emission elements in the display panel.

14. The display panel of claim 13, wherein the first data signal, the second data signal, and the third data signal respectively correspond to the first color, the second color, and the third color.

15. A light emitting display comprising:

a display area comprising a plurality of data lines for transmitting a data signal, a plurality of scan lines for transmitting a selection signal, and a plurality of pixels each coupled to a corresponding one of the data lines and a corresponding one of the scan lines;

a data driver for time-dividing at least two data signals corresponding to one color and applying the time-divided data signals to the data lines in one field; and a scan driver for sequentially applying a selection signal to the plurality of scan lines in first and second subfields included in the one field, wherein the plurality of pixels each comprise at least two emission elements for emitting different colors from each other in response to an applied current, and a driver for operating the emission elements of the plurality of pixels by receiving the data signal while the selection signal is applied, wherein the driver sequentially operates only two emission elements for emitting one color corresponding to each other among the emission elements included in the plurality of pixels, the two emission elements for emitting the one color having at least one other emission element for emitting a color different from the one color positioned therebetween,

16. The light emitting display of claim 15, wherein the driver comprises:

a transistor comprising a first electrode, a second electrode, and a third electrode and outputting a current to the third electrode corresponding to a voltage applied between the first electrode and the second electrode;

a first capacitor coupled between the first electrode and the second electrode of the transistor; and a first switch for transmitting the data signal to the capacitor in response to the selection signal.

17. The light emitting display of claim 16, wherein the second electrode of the transistor is coupled to a first power, and the driver further comprises:

a second capacitor coupled between the first electrode of the transistor and the first capacitor;

a second switch for controlling the transistor to be diode-connected in response to a first control signal;

a third switch for applying a voltage of the first power to the first capacitor in response to a second control signal.

18. The light emitting display of claim 16, wherein the plurality of pixels comprise a first pixel group comprising a driver for operating at least two emission elements emitting a first color, a second pixel group comprising a driver for operating at least two emission elements emitting a second color, and a third pixel group comprising a driver for operating at least two emission elements emitting a third color.

19. The light emitting display of claim 18, wherein a white balance of the first color, second color and third color is controlled by controlling width and length ratios of a channel of the transistor of each of the first pixel group, the second pixel group and the third pixel group.

20. A method for driving a display panel comprising a plurality of data lines for transmitting a data signal, a plurality of scan lines for transmitting a selection signal, and a plurality of pixels respectively coupled to the data lines and the scan lines, the plurality of pixels including at least two emission elements for emitting different colors from each other, and operated by dividing one field into a plurality of subfields comprising first and second subfields, the method comprising:

sequentially applying the selection signal to the plurality of scan lines in the first subfield;

applying the data signal to the plurality of data lines in the first subfield;

transmitting a current corresponding to the data signal applied to one of the data lines when the scan signal is applied to one of the scan lines in the first subfield through a driver to a first emission element among the emission elements included in the plurality of pixels;

sequentially applying the selection signal to the plurality of scan lines in a second subfield;

applying the data signal to the plurality of data lines in the second subfield; and transmitting the current corresponding to the data signal applied to the one of the data lines when the scan signal is applied to the one of the scan lines in the second subfield through a driver to a second emission element for emitting a color substantially corresponding to a color emitted by the first emission element among the emission elements included in the plurality of pixels, the second emission element being spaced apart from the first emission element and having at least a third emission element for emitting a different color positioned therebetween;

wherein the driver transmits the current corresponding to the data signal only to the first and second emission elements from among the emission elements in the display panel.

* * * * *

UNITED STATES PATENT AND TRADEMARK OFFICE

CERTIFICATE OF CORRECTION

PATENT NO. : 8,547,300 B2
APPLICATION NO. : 11/157898
DATED : October 1, 2013
INVENTOR(S) : Kwak et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 2003 days.

Signed and Sealed this
Third Day of March, 2015

Michelle K. Lee

Michelle K. Lee
*Deputy Director of the United States Patent and Trademark Office*